US005631092A

United States Patent [19]

Komine

[11] Patent Number: 5,631,092

[45] Date of Patent: May 20, 1997

[54] SHEET FOR THERMAL MASS TRANSFER PRINTER

[75] Inventor: Tsutomu Komine, Tokyo, Japan

[73] Assignee: Nisshinbo Industries, Inc., Tokyo, Japan

[21] Appl. No.: 501,990

[22] Filed: Jul. 13, 1995

[30] Foreign Application Priority Data

Jul. 28, 1994 [JP] Japan ..... 6-194584

[51] Int. Cl.[6] ..... B41M 5/26

[52] U.S. Cl. ..... 428/523; 428/195; 428/206; 428/207; 428/331; 428/913; 428/914

[58] Field of Search ..... 428/195, 206, 428/207, 331, 913, 914, 523

[56] References Cited

U.S. PATENT DOCUMENTS 5,204,179 4/1993 Baker et al. ..... 428/336

5,242,888 9/1993 Atherton et al. ..... 503/227

*Primary Examiner*—Bruce H. Hess

*Attorney, Agent, or Firm*—Wenderoth, Lind & Ponack

[57] ABSTRACT

A sheet for thermal mass transfer printers includes a non-oriented film containing 5–45 wt. % of inorganic pigment, the non-oriented film preferably being a non-oriented film of polypropylene or polyethylene and preferably being coated on at least one side with an ink receiving layer.

5 Claims, No Drawings

SHEET FOR THERMAL MASS TRANSFER PRINTER

BACKGROUND OF THE INVENTION

1. Field of the Invention

This invention relates to a sheet (e.g., printing paper sheet) particularly for printing with a high-definition thermal mass transfer printer.

2. Description of the Background Art

Transparent oriented polyester film, oriented white polyester film having an internal inorganic filler, oriented synthetic paper utilizing polypropylene resin with cushioning property (e.g., Yupo, product of Oji-Yuka Synthetic Paper Co., Ltd.), oriented polyolefine film or the like coated with an ink receiving layer have conventionally been used as sheets for printing with thermal mass transfer printers.

The sheet consisting of polyester film coated with an ink receiving layer exhibits high printing density but is expensive and an unpleasant feel.

The sheet consisting of oriented polyolefine film coated with an ink receiving layer exhibits high printing density, has good feel and can be used when high resolution is not required (when the definition is not high).

When the printer resolution is increased for achieving high definition, however, the quality of the printing is poor owing to poor dot registration when several colors are printed one on top of another.

This is thought to be due to stretching (elongation) of the sheet during feed. Specifically, when several colors are printed one on another in high-resolution printing, the sheet is squeezed within the printer for precise positioning of the dots, and this is thought to cause elongation.

Similarly, when oriented polypropylene film is used for printing with a high-definition printer, the printing quality is degraded when several colors are superimposed since the dots do not register well.

Some sheets available for printing with high-definition printers enable high printing density and good dot registration but have poor texture (feel), while others have good feel but poor dot registration. None of the prior art sheets provides both good feel and good printing quality (no dot shift when several colors are superimposed).

SUMMARY OF THE INVENTION

The object of this invention is to provide a sheet for high-definition thermal mass transfer printers which exhibits high printing density, good feel and excellent printing quality (no dot shift when several colors are superimposed).

The invention achieves this object by providing a sheet for thermal mass transfer printers utilizing a non-oriented film containing inorganic pigment.

Resins usable for the film include, for example, polyolefine, polypropylene, polyethylene, polyester, polycarbonate, cellulose acetate, polyvinyl chloride, polyvinyl alcohol, polyvinylidene chloride, polyvinyl acetate, polystyrene, nylon and fluorocarbon resin.

Among these, non-oriented polyolefine film containing inorganic pigment is particularly notable for freedom from dot shift in superimposed color printing (freedom from elongation) and for its good feel.

While non-oriented film has been considered inferior in strength and larger in dot shift than oriented film, non-oriented polyolefine films containing inorganic pigment, particularly non-oriented polyethylene film and non-oriented polypropylene film containing inorganic pigment, are preferable in terms of balance between resistance to elongation and good feel. Between these, non-oriented polypropylene film is particularly preferable.

While non-oriented polyolefine film decreases in elongation and increases in printing density as its inorganic pigment content increases, a high inorganic pigment content makes it brittle.

While the type of inorganic pigment contained in the sheet is not particularly specified, titanium oxide, calcium carbonate, talc and the like are preferable from the points of effect on elongation and ease of production.

Since a low content of inorganic pigment produces no elongation eliminating effect and a high content thereof causes brittleness, the inorganic pigment content of the non-oriented film is specified as 5–45 wt. %, preferably 35–45% wt. %.

When the inorganic pigment content exceeds 35%, a high printing density is obtained even without provision of an ink receiving layer on the printing surface. This is thought to be because the added inorganic pigment produces a certain degree of surface roughness and thereby improves ink transfer.

Irrespective of the inorganic pigment content, the printing density can be increased to the level required by provision of an ink receiving layer.

A sheet containing inorganic pigment also enjoys improved handling property.

The density of an easy-to-handle film is in the range of 1.0–1.5 g/cm$^3$, preferably 1.3–1.5 g/cm$^3$.

While non-oriented film has less stiffness than oriented film, its stiffness improves in the aforesaid range of inorganic pigment content. The Clark stiffness values in this range (at a film thickness of 126–233 μm) were MD: 15–50 cm$^3$/100, CD: 20–55 cm$^3$/100.

The Clark stiffness was measured in accordance with JIS-P8143 as follows. A specimen measuring 3 cm in the MD direction and 30 cm in the CD direction was cut from the film. The specimen was clamped in the MD direction and held horizontal in the clamped direction. It was rotated clockwise about the clamped axis and the angle at which the sample fell over was read. Next it was rotated counterclockwise and the angle at which it fell over was read. The cube of the distance (cm) from the axis to the end of the sample when the sum of the left and right fall-over angles was 90°±5° was divided by 100 to obtain the Clark stiffness value in the CD direction.

A specimen measuring 3 cm in the CD direction and 30 cm in the MD direction was cut from the film and clamped in the CD direction for measuring the Clark stiffness in the MD direction in the same manner.

If required, the sheet for thermal mass transfer printers according to the invention can be added with an antioxidant, ultraviolet absorber, antistatic agent, flame retardant, slip additive, mildew proofer, surfactant, antiblocking agent and the like.

While the non-oriented film containing inorganic pigment can itself be used as the sheet for thermal mass transfer printers according to the invention, it is preferably provided on its printing surface with an ink receiving layer since this increases the printing density.

The ink receiving layer is for forming dots by receiving ink transferred by heat supplied from a thermal head in accordance with an electric signal representing the image being printed.

It is formed mainly of resin exhibiting good ink transfer property. Specific examples of the main component include saturated copolymerized polyester resin, acrylic acid resin, methacrylic acid resin, copolymerized resins of these, vinyl chloride resin, vinyl chloride-acrylic resin, and vinyl chloride-vinyl acetate resin.

Inorganic and organic pigments such as silica, calcium carbonate, titanium oxide, polystyrene can be added in addition to the resin. A wetting agent, surfactant, antistatic agent, fluorescent brightening agent and the like can also be added.

If adherence between the ink receiving layer and the non-oriented film is poor, an easily adhesive layer can be provided between the two.

Products are commercially available for both layers. They can be applied by ordinary coating methods, such as by application with a roll coater or by spraying, followed by drying.

The easily adhesive layer can be formed by coating the film with a coating solution such as Seikadyne SP-25 (K-3) (product of Dainichi Colour & Chemicals Mfg. Co., Ltd.), Acronal YJ-2721D (product of Mitsubishi Chemical BASF Company Limited) or the like at a coating weight of about 1 g/m$^2$ (dry weight).

The ink receiving layer can be formed by coating with Vylonal MD-1200 (product of Toyobo Co., Ltd.), Fine TEX ES-850 (product of Dainippon Ink And Chemicals, Incorporated) or the like at a coating weight of 5 g/m$^2$ (dry weight).

Non-oriented films are generally poor in heat resistance and soft. When a sheet consisting of non-oriented film containing inorganic pigment is repeatedly printed with several colors in a high-definition thermal mass transfer printer, however, the sheet does not stretch and no dot shift occurs.

In addition, the printed sheet consisting of non-oriented film containing inorganic pigment has good feel owing to the cushioning property of the film itself.

EXAMPLES

The invention will now be explained with reference to specific examples.

Performance was judged based on the following criteria:

(1) The dot registration in A4 size printing was evaluated in terms of ratio of dot shift to dot diameter as A when absolutely no shift occurred, B when shift occurred but was less than 2/10 of dot diameter, C when shift was between 2/10 and less than 4/10 of dot diameter, D when shift was 4/10 of dot diameter or greater.

(2) Feel was evaluated as

Good (○) when soft,

Bad (x) when hard,

Excellent (◎) when neither too soft nor too hard.

(3) Printing density was evaluated by printing in 8 gradations with a Color Point 2 (300 DPI) printer (product of Seiko Instrument Inc.) and measuring the OD value of the 8th gradation of cyan with a Macbeth densitometer (product of Macbeth). The printing density was rated sufficiently high when the measured value was not less than 1.55, and values between 1.50 and 1.54 were considered adequate for practical purposes.

Example 1

An easily adhesive layer was formed on a TKP-120 non-oriented film (thickness: 128 μm, density: 1.1 g/cm$^3$, Clark stiffness MD: 23 cm$^3$/100, CD: 26 cm$^3$/100; product of Tatsuno Chemical Inc.) consisting mainly of high-density polyethylene resin and inorganic pigments (titanium oxide and calcium carbonate in a total of 8–10 wt. %), and an ink receiving layer was formed on the easily adhesive layer to obtain a sheet according to the invention. The sheet was printed using a Color Point 2 (300 DPI) printer (product of Seiko Instrument Inc.).

The easily adhesive layer was formed by applying a coat of Seikadyne SP-25 (K-3) (product of Dainichi Colour & Chemicals Mfg. Co., Ltd.) so as to obtain a coating weight after drying of 2–3 g/m$^2$.

The ink receiving layer was formed by applying a coat of Vylonal MD-1200 (product of Toyobo Co., Ltd.) so as to obtain a coating weight after drying of 5–6 g/m$^2$.

The yellow, magenta and cyan dots were in good registration, with an offset of only about 0.5/10 dot diameter among the dots, and the feel of the sheet was excellent (neither too hard nor too soft).

Example 2

An easily adhesive layer was formed on a NAN YA 120μ Film non-oriented film (thickness: 130 μm, density 1.4 g/cm$^3$, Clark stiffness MD: 39 cm$^3$/100, CD: 44 cm$^3$/100; product of NAN YA PLASTICS CORPORATION) consisting mainly of polypropylene resin and inorganic pigments (titanium oxide, calcium carbonate and talc in a total of 41 wt. %), and an ink receiving layer was formed on the easily adhesive layer to obtain a sheet according to the invention.

The easily adhesive layer was formed by applying a coat of Acronal YJ-2721D (product of Mitsubishi Chemical BASF Company Limited) so as to obtain a coating weight after drying of 1–2 g/m$^2$.

The ink receiving layer was formed by applying a coat of Fine TEX ES-850 (product of Dainippon Ink And Chemicals, Incorporated) so as to obtain a coating weight after drying of 4–5 g/m$^2$.

When the sheet was printed in the same manner as in Example 1, the yellow, magenta and cyan dots were in good registration, with no offset whatsoever among the dots, and the feel of the sheet was excellent (neither too hard nor too soft). In addition, the printing density was high.

Example 3

In the same manner as in Example 1, an easily adhesive layer was formed on a TKP-90 non-oriented film (thickness: 92 μm, density: 1.1 g/cm$^3$, Clark stiffness MD: 13 cm$^3$/100, CD: 14 cm$^3$/100; product of Tatsuno Chemical Inc.) consisting mainly of high-density polyethylene resin and inorganic pigments (titanium oxide and calcium carbonate in a total of 8–10 wt. %), and an ink receiving layer was formed on the easily adhesive layer to obtain a sheet according to the invention.

When the sheet was printed in the same manner as in Example 1, the yellow, magenta and cyan dots were in good registration, with an offset of only about 0.5/10 dot diameter among the dots, and the feel of the sheet was excellent (neither too hard nor too soft). In addition, the printing density was high.

Example 4

A sheet was obtained in the same manner as in Example 1, except that a 100 μm non-oriented polypropylene film consisting mainly of polypropylene and inorganic pigments (titanium oxide, calcium carbonate and talc in a total of 5 wt. %) was used as the base material.

When the sheet was printed in the same manner as in Example 1, the yellow, magenta and cyan dots were in good registration, with an offset of only about 0.5/10 dot diameter among the dots, and the feel of the sheet was excellent (neither too hard nor too soft). In addition, the printing density was high.

Example 5

A sheet was obtained in the same manner as in Example 1, except that a 100 μm non-oriented polypropylene film consisting mainly of polypropylene and inorganic pigments (titanium oxide, calcium carbonate and talc in a total of 10 wt. %) was used.

When the sheet was printed in the same manner as in Example 1, the yellow, magenta and cyan dots were in good registration, with an offset of only about 0.5/10 dot diameter among the dots, and the feel of the sheet was excellent (neither too hard nor too soft). In addition, the printing density was high.

Example 6

A sheet was obtained in the same manner as in Example 1, except that a 100 μm non-oriented polypropylene film consisting mainly of polypropylene and inorganic pigments (titanium oxide, calcium carbonate and talc in a total of 30 wt. %) was used.

When the sheet was printed in the same manner as in Example 1, the yellow, magenta and cyan dots were in good registration, with an offset of only about 0.5/10 dot diameter among the dots, and the feel of the sheet was excellent (neither too hard nor too soft). In addition, the printing density was high.

Example 7

A sheet was obtained in the same manner as in Example 5, except that titanium oxide alone was used as inorganic pigment.

When the sheet was printed in the same manner as in Example 1, the yellow, magenta and cyan dots were in good registration, with an offset of only about 0.5/10 dot diameter among the dots, and the feel of the sheet was excellent (neither too hard nor too soft). In addition, the printing density was high.

Example 8

A sheet was obtained in the same manner as in Example 5, except that calcium carbonate alone was used as inorganic pigment.

When the sheet was printed in the same manner as in Example 1, the yellow, magenta and cyan dots were in good registration, with an offset of only about 0.5/10 dot diameter among the dots, and the feel of the sheet was excellent (neither too hard nor too soft). In addition, the printing density was high.

Example 9

A sheet was obtained in the same manner as in Example 5, except that talc alone was used as inorganic pigment.

When the sheet was printed in the same manner as in Example 1, the yellow, magenta and cyan dots were in good registration, with an offset of only about 0.5/10 dot diameter among the dots, and the feel of the sheet was excellent (neither too hard nor too soft). In addition, the printing density was high.

Example 10

The TKP-120 non-oriented film of Example 1 was directly printed in the same manner as in Example 1. The yellow, magenta and cyan dots were in good registration, with an offset of only about 0.5/10 dot diameter among the dots, and the feel of the sheet was excellent (neither too hard nor too soft). In addition, the printing density was fairly high.

Example 11

The NAN YA 120μ Film non-oriented film of Example 2 was directly printed in the same manner as in Example 1. The yellow, magenta and cyan dots were in good registration, with no offset whatsoever among the dots, and the feel of the sheet was excellent (neither too hard nor too soft). In addition, the printing density was high.

Example 12

A non-oriented polyester film consisting mainly of polyester and inorganic pigment (titanium oxide, calcium carbonate and talc in a total of 10 wt. %) was printed in the same manner as in Example 1. The yellow, magenta and cyan dots were in good registration, with an offset of only about 1.5/10 dot diameter among the dots, and the printing density was fairly high. In addition, the feel of the sheet was excellent.

Comparative Example 1

A sheet was obtained by using S Type 100 μm oriented polyester film (product of Teijin Limited) as the base material and providing the film with an ink receiving layer in the same manner as in Example 1.

When the sheet was printed in the same manner as in Example 1, the printing density was high but the offset among the yellow, magenta and cyan dots was 2/10 dot diameter and the feel was hard.

Comparative Example 2

A sheet was obtained in the same manner as in Example 1, except that a oriented film employing polypropylene resin was used as the base material.

When the sheet was printed in the same manner as in Example 1, the printing density was high but the feel was soft. The registration of the yellow, magenta and cyan dots was poor, with an offset of 5/10 dot diameter among the dots.

Comparative Example 3

A sheet was obtained by forming an easily adhesive layer on a 100 μm non-oriented polypropylene film consisting mainly of polypropylene in the same manner as in Example 2 and further providing an ink receiving layer on the easily adhesive layer in the same manner as in Example 1.

When the sheet was printed in the same manner as in Example 1, the printing density was high but the offset among the yellow, magenta and cyan dots was 2/10 dot diameter and the feel was soft.

Comparative Example 4

A sheet was obtained in the same manner as in Example 1, except that a non-oriented polystyrene film was used as the base material.

When the sheet was printed in the same manner as in Example 1, the printing density was high but the offset among the yellow, magenta and cyan dots was 2/10 dot diameter and the feel was somewhat soft.

Comparative Example 5

A sheet was obtained in the same manner as in Example 1, except that a non-oriented polyester film was used as the base material.

When the sheet was printed in the same manner as in Example 1, the printing density was high but the offset among the yellow, magenta and cyan dots was 2/10 dot diameter and the feel was somewhat soft.

Comparative Example 6

A non-oriented 100 μm polypropylene film was directly printed in the same manner as in Example 1. The feel was soft and the offset among the yellow, magenta and cyan dots was about 2/10 dot diameter. The printing density was low.

The results obtained in the Examples and Comparative examples are shown in Tables 1 and 2.

Use of the sheet (printing paper sheet) according to the invention for printing with a high-definition thermal mass transfer printer (resolution of 300 DPI or higher) makes it possible to obtain a printed sheet free of dot shift and having a good feel.

These effects are particularly pronounced when the high-definition printer is of the type in which the dots are superimposed on the printing surface without ink absorption by the printing surface layer at the time the ink is transferred from the ink sheet to the printing paper (e.g. Color Point 2 manufactured by Seiko Instrument Inc.).

What is claimed is:

1. A sheet for thermal mass transfer printers consisting of a non-oriented film containing at least 5–45% by weight of inorganic pigment.

2. The sheet for thermal mass transfer printers according to claim 1, wherein the non-oriented film is a non-oriented polypropylene film or a non-oriented polyethylene film.

3. The sheet for thermal mass transfer printers according to claim 1 or 2, wherein the non-oriented film is a polypropylene film containing 35–45% by weight of inorganic pigment.

4. A sheet for thermal mass transfer printers consisting of a non-oriented film containing at least 5–45% by weight of

TABLE 1

| Example | Film | Inorganic pigment | Content (%) | With ink receiving layer | Dot registration | Feel | Printing density |
|---|---|---|---|---|---|---|---|
| 1 | Non-oriented high-density polyethylene film | Titanium oxide, calcium carbonate | 8–10 | Yes | B | ● | 1.58 |
| 2 | Non-oriented polyethylene film | Titanium oxide, calcium carbonate, talc | 41 | " | A | ● | 1.60 |
| 3 | Non-oriented high-density polyethylene film | Titanium oxide, calcium carbonate | 8–10 | " | B | ● | 1.59 |
| 4 | Non-oriented polypropylene film | Titanium oxide, calcium carbonate, talc | 5 | " | B | ● | 1.59 |
| 5 | Non-oriented polypropylene film | Titanium oxide, calcium carbonate, talc | 10 | " | B | ● | 1.58 |
| 6 | Non-oriented polypropylene film | Titanium oxide, calcium carbonate, talc | 30 | " | B | ● | 1.58 |
| 7 | Non-oriented polypropylene film | Titanium oxide | 10 | " | B | ● | 1.59 |
| 8 | Non-oriented polypropylene film | Calcium carbonate | " | " | B | ● | 1.58 |
| 9 | Non-oriented polypropylene film | Talc | " | " | B | ● | 1.59 |
| 10 | Non-oriented high-density polyethylene film | Titanium oxide, calcium carbonate | 8–10 | No | B | ● | 1.51 |
| 11 | Non-oriented polypropylene film | Titanium oxide, calcium carbonate, talc | 41 | " | A | ● | 1.57 |
| 12 | Non-oriented polyester film | Titanium oxide, calcium carbonate, talc | 10 | " | B | ● | 1.52 |

TABLE 2

| Comparative Example | Film | Inorganic pigment | Content (%) | With ink receiving layer | Dot registration | Feel | Printing density |
|---|---|---|---|---|---|---|---|
| 1 | Oriented polyester film | None | 0 | Yes | C | X | 1.57 |
| 2 | Oriented polypropylene film | " | 0 | " | D | ○ | 1.58 |
| 3 | Non-oriented polypropylene film | " | 0 | " | C | ○ | 1.59 |
| 4 | Non-oriented polystyrene film | " | 0 | " | C | ○ | 1.58 |
| 5 | Non-oriented polyester film | " | 0 | " | C | ○ | 1.57 |
| 6 | Non-oriented polypropylene film | " | 0 | No | B | ○ | 1.44 |

an inorganic pigment, and wherein at least one surface of the film has an ink receiving layer.

5. The sheet for thermal mass transfer printers according to claim 4, wherein the non-oriented film is a polypropylene film containing 35–45% by weight of inorganic pigment.

* * * * *